United States Patent [19]

Zueckler

[11] 4,445,015

[45] Apr. 24, 1984

[54] VACUUM SWITCHING TUBE WITH A RING TO GENERATE AN AXIAL MAGNETIC FIELD

[75] Inventor: Karl Zueckler, Berlin, Fed. Rep. of Germany

[73] Assignee: Siemens AG, Berlin and Munich, Fed. Rep. of Germany

[21] Appl. No.: 451,909

[22] Filed: Dec. 21, 1982

[30] Foreign Application Priority Data

Dec. 23, 1981 [DE] Fed. Rep. of Germany ..... 3151907

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,591,743 | 7/1971 | Ranheim | 200/144 B |
| 3,818,164 | 6/1974 | Mizutani et al. | 200/144 B |
| 4,196,327 | 4/1980 | Kurosawa et al. | 200/144 B |

FOREIGN PATENT DOCUMENTS

| | | |
|---|---|---|
| 2638700 | 3/1978 | Fed. Rep. of Germany . |
| 2443141 | 1/1979 | Fed. Rep. of Germany . |
| 2911706 | 10/1980 | Fed. Rep. of Germany . |
| 1428446 | of 1966 | France . |
| 2235469 | of 1975 | France . |
| 2002177 | 2/1979 | United Kingdom . |
| 2038098 | 7/1980 | United Kingdom . |

OTHER PUBLICATIONS

IEEE Publication 80 SM 700-5 from Summer 1980 Meeting.

*Primary Examiner*—Robert S. Macon

*Attorney, Agent, or Firm*—Karl F. Milde, Jr.; Andrew G. Rodau

[57] ABSTRACT

A vacuum switching tube with a ring to generate an axial magnetic field.

A vacuum switching tube is provided with a switching device member 12, which includes a conventional switching device 14 and an immediately adjacent axial field coil, which essentially consists of a galvanic open ring 20 with radially branching off conductor devices 22, 23 for current sink and drain. The inner diameter of the ring 20 approximates the outer diameter of the switching device 14. In this manner, an axially directed magnetic field is generated in the area of the contact surface of the switching device. The axially magnetic field counteracts the contraction of the switching light arcs.

5 Claims, 7 Drawing Figures

VACUUM SWITCHING TUBE WITH A RING TO GENERATE AN AXIAL MAGNETIC FIELD

BACKGROUND OF THE INVENTION

This invention relates to a vacuum switching tube with a ring to generate an axial magnetic field.

The innovation addresses a vacuum switching tube with two switching devices of basically cylinder-disk shaped design. The switching devices can be moved in relation to one another and are attached to a bearing post. In order to generate an axially directed magnetic field, a galvanic open ring is attached to the back of the switching devices. The galvanic open ring is in contact with the bearing post via a radially arranged conductor device.

A vacuum switching tube of this type has been described in the publication 80 SM 700-F IEEE PAS during the summer meeting of 1980. In this case, the ring has approximately the same outer diameter as the actual switching device and is subdivided into quadrants in the direction of its circumference. Each of these quadrants is connected to the respective conductor device extending from the center. Over this connection the current flows from the bearing post to the quadrant. To provide current flow to the switching device the free ends of the quadrants of the ring are provided with elevations. Furthermore, the switching device has several radial slots to suppress the eddy current during zero current crossing. However, these slots limit the switching capacity of the vacuum switching tube, because the light arcs have the tendency to settle at the edges where they cause increased burn-up with corresponding metallic vapor formation. It is also known, that an axial magnetic field can be generated by a field coil attached to the outside of the vacuum sealed housing (DE-A29 11 706). Although this configuration does not limit the design of the switching device, the field coil requires considerable conductor material and space.

SUMMARY OF THE INVENTION

This innovation creates a switching device configuration with an interruption-free contact surface for the light arc by using a ring as a field coil. The ring is in an axial position adjacent to the switching device.

According to this innovation, the inner diameter of the ring approximates the outer diameter of the switching device, and the ring has only one separating groove. The conductor device connected to the bearing post is located immediately adjacent to the separating groove. Furthermore, an additional conductor device leading to the center of the switching devices branches off the separating groove.

Because in this instance the current supply to the actual switching device is performed centrally, that is to say, from that point where in conventional configurations the switching device is connected to the bearing post, all commonly used switching device designs can be used for this mounting mode. Especially suitable for this purpose are the so called pot contact devices with an interruption-free contact ring, which are described in DE-A26 38 700. Through the slanted slots located below the contact ring, the pot contact devices cause the light arc to circulate around the ring surface. If in addition the axial magnetic field of the ring acting as a field coil becomes effective, the switching capacity is considerably increased, because the magnetic field counteracts the contraction of the light arc during high currents, and consequently keeps burn-up and metallic vapor formation low. It is essential, that the axial magnetic field is already available at the periphery of the switching device and that it permeates the entire surface of the switching device. Because the field coils of the interacting switching devices have an identical current flow, magnetic forces are effective during the closed switch status. These magnetic forces prevent the removal of the switching device during the influence of transient currents.

Based on past experiences, it is recommended that the conductor devices be designed as cross-sectional triangles which together form a rectangle. If problems arise due to the repulsive forces created by the magnetic field between the conductor devices, the conductor devices can be installed to create a distance between the feed-in locations of the ring and its circumference. It is also recommended that the separating groove of the ring be filled in at least locally with non-conductive or poorly conductive support units to increase mechanical stability.

To further increase the mechanical stability, non-conductive or poorly conductive support units should be placed at least locally between the ring and the switching device. Additionally, increased mechanical stability can be effected by adding a support ring of non-conductive or poorly conductive material. The support ring should be located on the bearing post and on the side of the ring which faces away from the switching device.

In order to mount the contact system, several advantages can be realized by using a central fastening element, which connects both the switching device and the ring with the bearing post. In order not to interrupt the desired current distribution, this particular fastening element can be manufactured from non-conductive or poorly conductive materials.

For a full understanding of the present invention, reference should now be made to the following detailed description of the preferred embodiments of the invention and to the accompanying drawings.

BRIEF DESCRIPTION OF THE DRAWINGS

The details of the switching device arrangements illustrated in FIG. 1 can be seen in FIG. 2 and FIG. 3, depicting an axial view. FIG. 3 shows the switching device in transverse position to the radial conductor devices of the ring, while FIG. 4 also provides a top view of the ring.

Similar to the drawing provided in FIG. 3.

DESCRIPTION OF THE PREFERRED EMBODIMENTS

Figure 1:
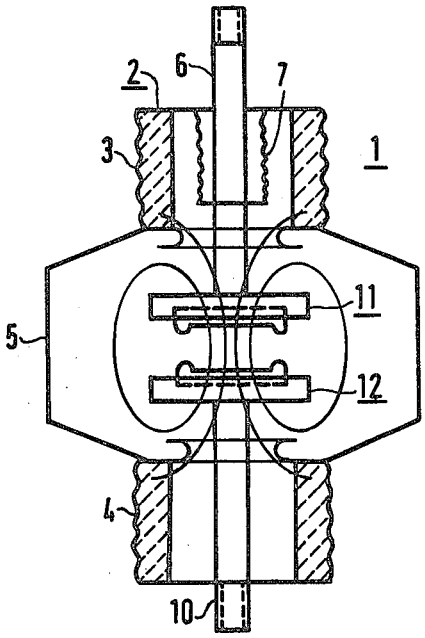
FIG. 1 is a longitudinal view of a vacuum switching tube, whereby each switching device is provided with the invented ring acting as a field coil.

In accordance with FIG. 1, the vacuum switching tube consists of a vacuum sealed housing 2, which includes two essentially hollow cylindrically shaped insulation units 3 and 4 manufactured from a ceramic material and located at the upper and lower ends, as well as a medium-sized hollow metal cylinder 5.

A moveable bearing post 6 extends upward from housing 2. A spring bellow is used as insulation between 2 and 6. A second bearing post 10 aligned with bearing post 6, however, permanently connected to housing 2, extends from the insulation unit 4 located opposite from housing 2.

Bearing posts 6 and 10 are used to support a mobile switching device member 11 and a stationary switching device member 12. Their identical structure is described below.

Figure 2:
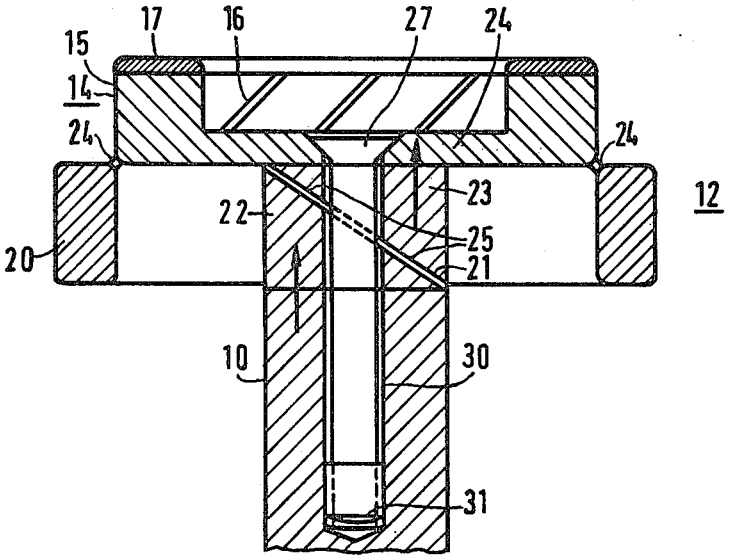

The switching device members 11 and 12 are in accordance with the configuration shown in FIG. 2. The actual switching deivce 14 is a so called pot contact with closed contact surface, as i.e. described in DE-A-26 38 700. The most pertinent components of the switching device 14 are a pot shaped body 15 made of copper. Its edge has been provided with slanted slots 16. The circular, ring-shaped edge of body 15 is covered with a non-slotted ring made from a chrome-copper alloy.

A field coil shaped as a ring 20 is attached to switching device 14. The inner diameter of the ring approximates the outer diameter of switching device 14. Furthermore, the ring is provided with a slanted separating groove 21. At each side of the groove, two radial conductor devices in the form of spokes 22 and/or 23 feed into the ring. Spokes 22 and 23 are electrically insulated from one another (FIG. 3) are tiered in the center of the ring 20. Arrows indicate, the the current flowing through the bearing post enters the ring 20 through spoke 22, flows through the ring and is returned to the center of the ring by spoke 23. At this location an electrical connection exists with the base 24 of the switching device 14, through which the current reaches the actual ring shaped contact area.

As can be seen in FIG. 2, the current flowing through the galvanic open ring generates an axial magnetic field. Because of the corresponding diameters of the switching device 14 and ring 20, the magnetic field is already effective at the outer edge of the contact ring 17. This magnetic field has the effect to counteract the contraction of a diffused light arc discharge into a concentrated light arc channel. The switching capacity of a vacuum switching tube can be considerably increased, because the contact ring 17 heats up less and subsequently releases less metallic vapors. The configuration of the slanted slots 16 aid this process. In conjunction with opposingly arranged slots of the switching device configuration 11 not shown in FIG. 2, slots 16 effect the rapid movement of the light arc across the contact surface of contact ring 17.

An especially favorable interaction between the slotted switching device 14 and ring 20 is achieved, when slots 16 are designed in such a manner, that they extend into the pot base 14 and as far as possible into the center. If this is the case, eddy currents, which create a dephased and therefore interrupting magnetic field during zero current crossing, can be largely suppressed. The arrangement of the slots can be seen in detail in FIG. 5, where they are identified with number 42.

As can be seen, the switching device 14 and ring 20 are axially positioned and immediately adjacent to one another. In the area of the edges facing one another, the supporting units 24 poorly conductive materials, i.e. ceramic. The units are added for support and electrical insulation between the switching device 14 and ring 20. Similar supporting units 25 have been installed between the separating groove 21 and spokes 22 and 23. These supporting bodies extend from the separating groove 21 of the ring 20. However, the surfaces of spoke 23 and the base 24 of the switching device are in contact to allow the current to flow to the switching device. This configuration is held together by a screw 27, which extends through the base 24 of the switching device 14 as well as the central part of spokes 22 and 23. Said screw is threaded into the tapped blind hole 20 of the bearing post 10. The coiled lower end 31 of screw 27 has been enlarged, so that the remaining length between the screw 27 and the spokes as well as the tapped blind hole is free of contact. Therefore only a small part of the current can flow directly from the bearing post 10 to the switching device 14, which is lost for the generation of the desired axial magnetic field. However, if the screw 27 is manufactured from poorly conductive material, said loss can be further reduced.

Figure 3:
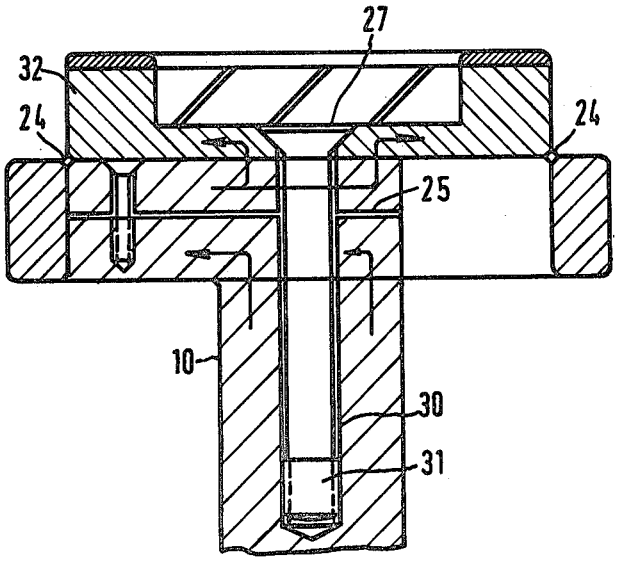

The current flows in opposite direction through spokes 22 and 23. This leads to repulsive forces, which can be absorbed in different ways. For example, a configuration of one or several screws or similar fastening modes 32 can be used, as seen in FIG. 3.

Figure 4:
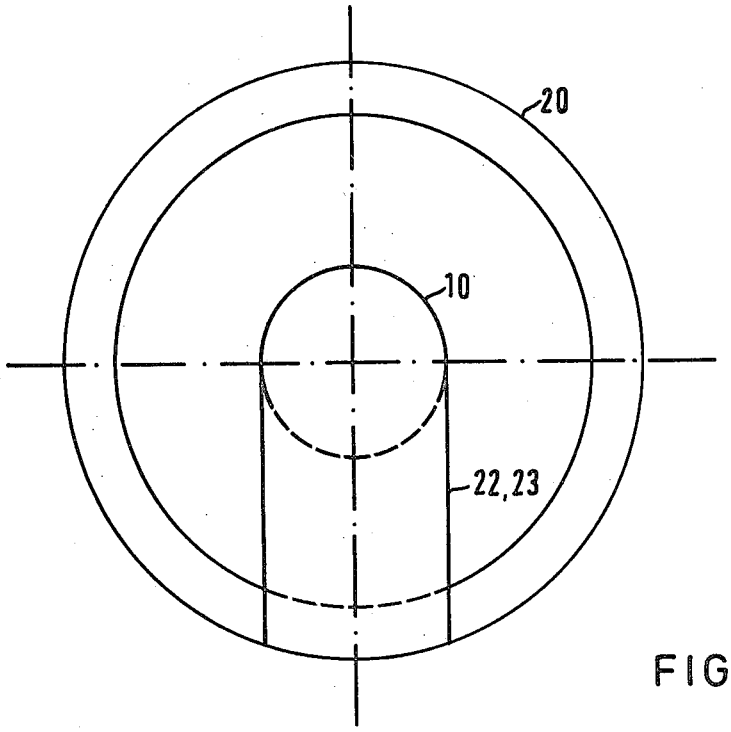
FIG. 4 illustrates the switching device in longitudinal perspective to the conductor devices.

The forces of the current acting on spokes 22 and 23 can be more easily controlled, if the following is provided. In place of the triangular cross section design as illustrated in FIG. 3, which results in a triangle, at least in one part of the radial length of the spokes, both spokes should be of rectangular shape, whereby the groove located between them should be parallel positioned to the switching device plane. The repulsive forces will be only effective in the axial direction while, with spokes designed as illustrated in FIG. 3, they also include a tangential component, which enlarges the ring. However, in both cases the spokes are tiered as illustrated in the top view provided by FIG. 4.

Figure 6:
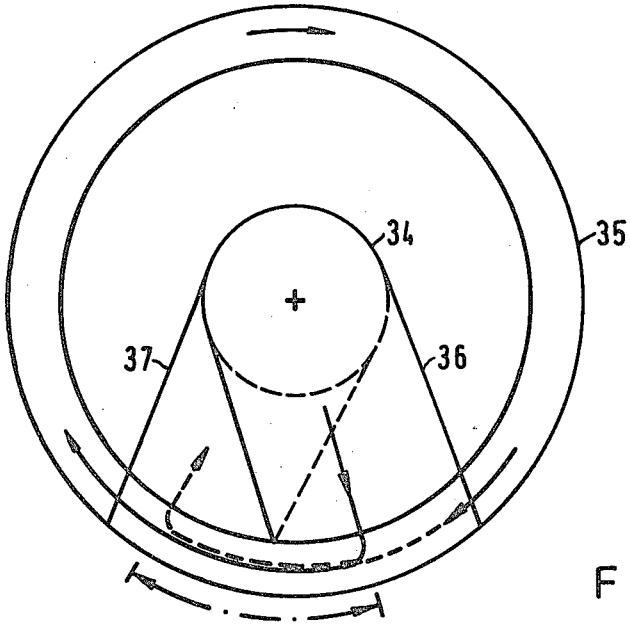
Figure 5:
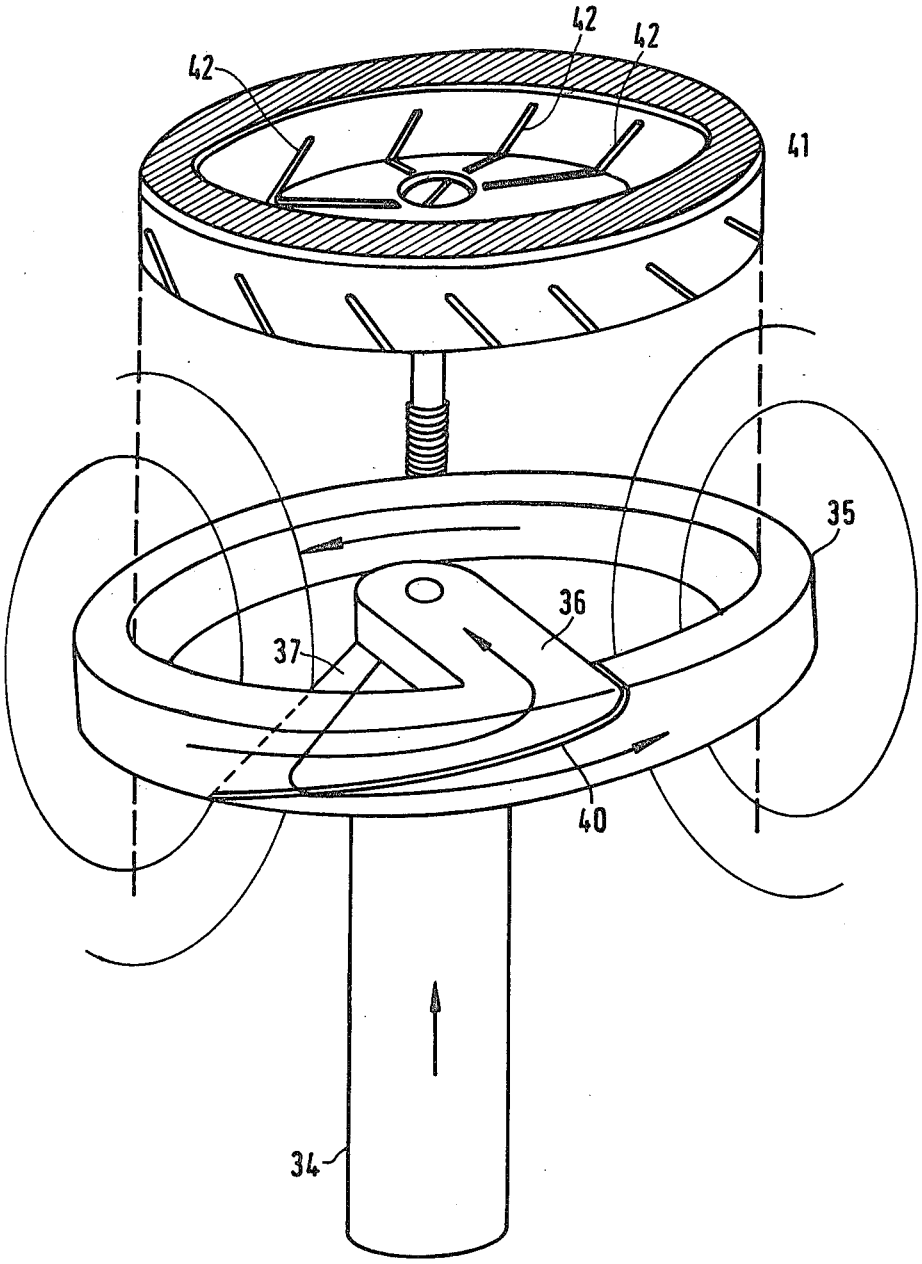
FIG. 5 is an expanded drawing of the switching device with the corresponding ring. The ring which is illustrated from a different perspective than seen in FIGS. 2, 3 and 4, is depicted in a top view in FIG. 6.

However, if the spokes are arranged in accordance with FIGS. 5 and 6, they feed into the ring while a distance is created between them and the circumference of the ring. If properly positioned, the repulsive forces are compensated and a ring configuration will be created which is largely void of current forces. In this alternate design, the ring acting as a field coil is identified as 35, and the upper spoke which is connected to the base of the switching device as 36, and the lower spoke as 37. This configuration effects that in one section of the circumference, namely across the length of the separating groove 40, the current flows in the same direction on both sides of the groove, resulting in magnetic forces. At the same time, the repulsive forces of the opposite current flow through 36 and 37 are relatively small because of their enlarged distance. This distribution of the current i, entering through the bearing post 34, is indicated by arrows in both FIGS. 5 and 6.

FIG. 5 provides an expanded drawing of the actual switching device 41 and ring 35. Essentially this switching device corresponds to the already described switching device 14 illustrated in FIG. 2. In addition, it can be seen, that the slanted slots 42, which provide a current loop to drive the switching light arcs in the direction of the circumference, extend into bolt 43 and nearly reach the center.

Figure 7:
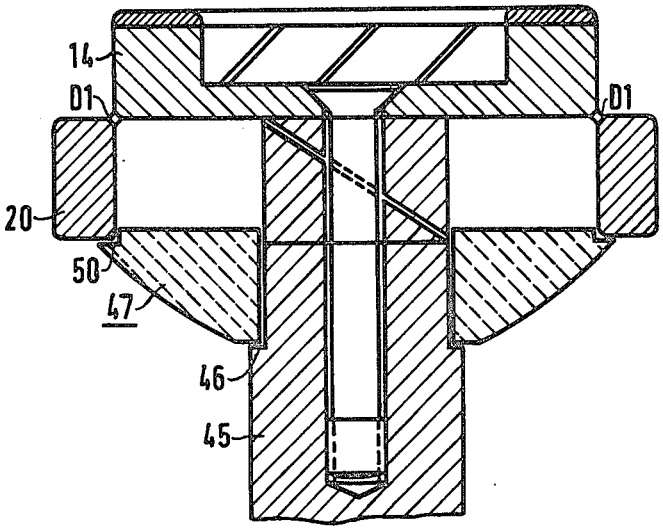
FIG. 7 shows an axial sectional view of the switching device configuration, including a support ring.

The switching devices of vacuum switching tubes, especially those for higher nominal currents and switching performance, are exposed to considerable mechanical stress. If it is required that the described contact configuration is especially mechanically stress resistant, a support ring in accordance with FIG. 7 can be used. In general, the switching device configuration corresponds to those illustrated in FIGS. 2 and 3. In addition, the bearing post 45 is provided with a ledge on which i.e. a support ring 47 of ceramic material is located. At its outer circumference, the support ring has an indentation 50, onto which the ring 20 acting as field coil is positioned. The repulsive forces acting on the switching device and the ring during activating of the ON mode do not have to be absorbed by these parts alone, but will be conducted to the bearing post 45 via the supporting ring 47. In some cases it might suffice to replace the closed support ring with the equally effective support unit with radial arms extending from a ring shaped hub to partially support the ring acting as a field coil.

Above described examples are based on the concept that an especially high switching capacity can be achieved by combining an axial magnetic field with pot contact devices provided with slanted slots, with which the switching light arcs are circulated on a ring surface. However, if maximum switching capacity is not required, it will suffice to use a switching device of simpler design.

According to the requirements of the application area, the vacuum switching tube can be relatively easily adjusted to meet the requested switching capacity.

There has thus been shown and described a novel vacuum switching tube which fulfills all the objects and advantages sought therefore. Many changes, modifications, variations and other uses and applications of the subject invention will, however, become apparent to those skilled in the art after considering this specification and the accompanying drawings which disclose preferred modifications, variations and other uses and applications which do not depart from the spirit and scope of the invention are deemed to be covered by the invention which is limited only by the claims which follow.

What is claimed is:

1. A vacuum switching tube comprising:

a first and a second switching member, said first switching member located adjacent said second switching member, and said first switching member comprising means for moving relative to said second switching member, each of said switching members comprising, (a) a bearing post to support said switching member, (b) a ring shaped field coil comprising, an annular member, and a first and a second inwardly radiating spoke, said first inwardly radiating spoke being in electrically conductive contact with said bearing post and with said annular member, said second inwardly radiating spoke being electrically insulated from said bearing post and from said first inwardly radiating spoke, and in electrically conductive contact with said annular member, said continuous electrically conductive path existing from said first inwardly radiating spoke around said annular member to said second inwardly radiating spoke, and, (c) a switching device, said switching device being substantially pot shaped with an outer diameter substantially equal to the inner diameter of said ring shaped field coil, said switching device further comprising a contact surface around the upper raised edge, and a bottom portion in electrically conductive contact with said second inwardly radiating spoke, whereby said first and said second switching member can be brought into contact with each other so a continuous electrically conductive path exists from said bearing post of said first switching member to said bearing post of said second switching member.

2. The vacuum switching tube of claim 1 wherein said first inwardly radiating spoke is electrically insulated from said second inwardly radiating spoke by a separating groove which extends diagonally through said annular member of said ring shaped field coil.

3. The vacuum switching tube of claim 1 wherein each of said inwardly radiating spokes is substantially triangular, each of said inwardly radiating spokes has a first end and a second end, said first end of said first inwardly radiating spoke and said first end of said second inwardly radiating spoke being adjacent to each other at substantially the center of said annular member, said second end of said first inwardly radiating spoke and said second end of said second inwardly radiating spoke being in electrically conductive contact with said annular ring, said second end of said first inwardly radiating spoke and said second end of said second inwardly radiating spoke being adjacent to each other to form a substantially rectangular cross section.

4. The vacuum tube of claim 1 wherein said first and said second inwardly radiating spokes each have a first end and a second end, said first end of said first inwardly radiating spoke and said first end of said second inwardly radiating spoke being adjacent to each other at substantially the center of said annular member, said second end of said first inwardly radiating spoke and said second end of said second inwardly radiating spoke being in electrically conductive contact with said annular ring, said second end of said first inwardly radiating spoke being spaced a distance from said second end of said second inwardly radiating spoke.

5. The vacuum switching tube of claim 2 wherein said separating groove contains material resistant to electrical conduction.

* * * * *